US009249633B1

(12) United States Patent
Arizmendi

(10) Patent No.: US 9,249,633 B1
(45) Date of Patent: Feb. 2, 2016

(54) INSULATED TUBULAR CLAMP

(75) Inventor: Napoleon Arizmendi, Magnolia, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 852 days.

(21) Appl. No.: 13/531,021

(22) Filed: Jun. 22, 2012

(51) Int. Cl.
*E21B 17/10* (2006.01)

(52) U.S. Cl.
CPC ..... *E21B 17/105* (2013.01); *E21B 17/1035* (2013.01); *E21B 17/1078* (2013.01)

(58) Field of Classification Search
CPC E21B 17/105; E21B 17/1035; E21B 17/1078
USPC ..... 175/325.6
See application file for complete search history.

(56) References Cited

U.S. PATENT DOCUMENTS 3,410,613 A * 11/1968 Kuus ..... 175/325.7
4,088,186 A * 5/1978 Callihan et al. ..... 166/241.7
5,377,752 A * 1/1995 Farrara ..... 166/241.6
5,908,072 A 6/1999 Hawkins
6,006,830 A 12/1999 Barron et al.
6,283,205 B1 9/2001 Cannon
6,435,275 B1 8/2002 Kirk et al.
6,666,267 B1 12/2003 Charlton
7,100,641 B2 * 9/2006 Tyrer et al. ..... 138/110
2010/0059218 A1 3/2010 Whitelaw

* cited by examiner

*Primary Examiner* — William P Neuder
*Assistant Examiner* — Tara Schimpf
(74) *Attorney, Agent, or Firm* — King and Spalding LLP

(57) ABSTRACT

A casing centralizer which has an annular body having a substantially cylindrical bore extending longitudinally therethrough. The annular body is divided along its axis into two inter-connectable sections, each of which includes fins extending radially therefrom. Each inter-connectable section also includes at least one latch and at least one alignment guide, as well as at least one latch cavity configured for matingly receiving and interlocking with the at least one latch of the other inter-connectable section, and at least one alignment guide cavity configured for matingly receiving and interlocking with the at least one alignment guide of the opposing inter-connectable section. The two inter-connectable sections may then be clamped about a drill pipe for maintaining a centralized position of the drill pipe in a downhole casing.

19 Claims, 9 Drawing Sheets

INSULATED TUBULAR CLAMP

TECHNICAL FIELD

The invention relates generally to oil and gas exploration and production and, more particularly, to an apparatus for centrally positioning drill pipe in a borehole.

BACKGROUND

In the exploration and production of oil and gas, centralizers are used to keep casing, tubing, and/or sucker rods centered in a borehole for a number of reasons. For example, centralizers reduce friction while running in the hole or moving up and down, they protect the pipe or coupling, they insure a proper cement job, and, as in the case of some plastic centralizers, they act as electrical isolators.

In some cases, centralizer-like devices are run as "clamps" or "protectors" with a primary purpose to secure an electrical or hydraulic umbilical against a tubular, such as with ESP cables, SCSSV control lines, chemical injection lines, PDG-wires, and the like. In such applications, electrical insulation of the tubing from the casing is not important. Such systems are usually fabricated from metal, though economics (not functionality) may demand that plastic or insulating materials be used.

As systems are introduced that require an EM transmission line to be constructed of concentric tubular, it is important to keep the tubing from directly shorting out against the casing string. It is also desirable to keep the inner tubular more or less concentric with the casing string over the length of the well to minimize signal attenuation.

Some centralizers are fabricated as one piece and are slipped over one end of a drill pipe. A disadvantage of such centralizers is that they normally require additional components to anchor them in place on a drill pipe because, if they are left free to float so that they can slide until they hit an upset or a coupling, their linear placement is not controlled and then, even if they are placed on every 30 foot joint, they may end up being as much as almost two joints (i.e., almost 60 feet) apart, and thus be less effective.

Alternatively, centralizers may be designed so that they are hinged and pinned (or bolted) together, so that they must be assembled on a rig floor, and can be placed anywhere along a drill pipe or even over a threaded connection. A disadvantage of such centralizers is that they generally require additional hardware as part of the assembly and for securing it in place on a drill pipe. Such assembly can causes delays, especially if the loose pieces are dropped, because then work must stop to search for the lost piece or get a new piece. If proper provisions are not made and adhered to, pieces may fall into the wellbore and cause equipment failure. Having to take extra precautions to prevent small pieces of hardware from falling into the well bore, such as, for example, covering up around the pipe with tarp or plastic covers create a major tripping hazard. This hazardous condition is quickly worsened as more people and tools are involved in the operation. Another disadvantage of having to assemble a centralizer is that assembly generally requires at least two people, one person to hold the assembly while another person assembles the centralizer. Yet another disadvantage is the cost of having the extra components that secure the centralizer in place.

There is thus a need for a centralizer that can be easily, quickly, and safely installed and removed by a single person so that rig idle time is minimized and other personnel are freed up to perform other functions on a rig while installing or removing pipe from a well. Such systems and methods should, among other things, also provide tubing-to-casing electrical isolation and stand-off, and allow for fluids to pass relatively freely along the annulus to assist in running and pulling the tubing and to provide for circulation operations.

SUMMARY

The present invention, accordingly, provides a casing centralizer which has an annular body having a substantially cylindrical bore extending longitudinally therethrough. The annular body is divided along its axis into two inter-connectable sections, each of which includes fins extending radially therefrom. Each inter-connectable section also includes at least one latch and at least one alignment guide, as well as at least one latch cavity configured for matingly receiving and interlocking with the at least one latch of the other inter-connectable section, and at least one alignment guide cavity configured for matingly receiving and interlocking with the at least one alignment guide of the opposing inter-connectable section. The two inter-connectable sections may then be clamped about a drill pipe for maintaining a radially centralized position of the drill pipe in a downhole casing.

A disassembler tool is disclosed having at least one tab for inserting in the at least one latch cavity between the beveled end of at least one of the one or more latches and a wall of at least one of the one or more latch cavities to deflect the latch. At least one hook extends from the at least one tab configured for seating against a shoulder of at least one of the one or more latch cavities.

A method is also disclosed for centrally positioning drill pipe in a borehole casing using a casing centralizer having an annular body having a substantially cylindrical bore extending longitudinally therethrough, wherein the annular body is divided along its axis into at least a first section and a second section. The first section and the second section of the annular body are position opposite each other over a drill pipe. Force is then applied to move the first section and the second section toward each other together until the beveled end of each of the one or more latches is urged against the wall of a respective each of the one or more latch cavities thereby deflecting each of the one or more latches until the tooth extends pass the shoulder and the tooth surface of each of the one or more latches seats against a respective wall of the one or more latch cavities.

The method of disassembling the two sections of the centralizer is disclosed using a tool, each of which tools include one or more tabs, and each of the tabs includes at least one hook. At least one tab of each of the tools is inserted through a respective one of one or more access slots of the centralizer proximate to a respective one of the one or more latches or proximate to a respective one of the one or more latch cavities between the beveled end of each of the one or more latches and a wall of respective the one or more latch cavities thereby deflecting the one or more latches until the tooth surface of each of the one or more latches is unseated from the shoulder of each of respective the one or more latch cavities. The one or more hooks are seated against a respective hook shoulder of the centralizer by moving the tools longitudinally to interlock the tools to the respective first section and the second section of the centralizer. Force is then applied radially to each tool in opposing directions to separate the first section from the second section of the centralizer and thereby remove the centralizer from the drill pipe.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
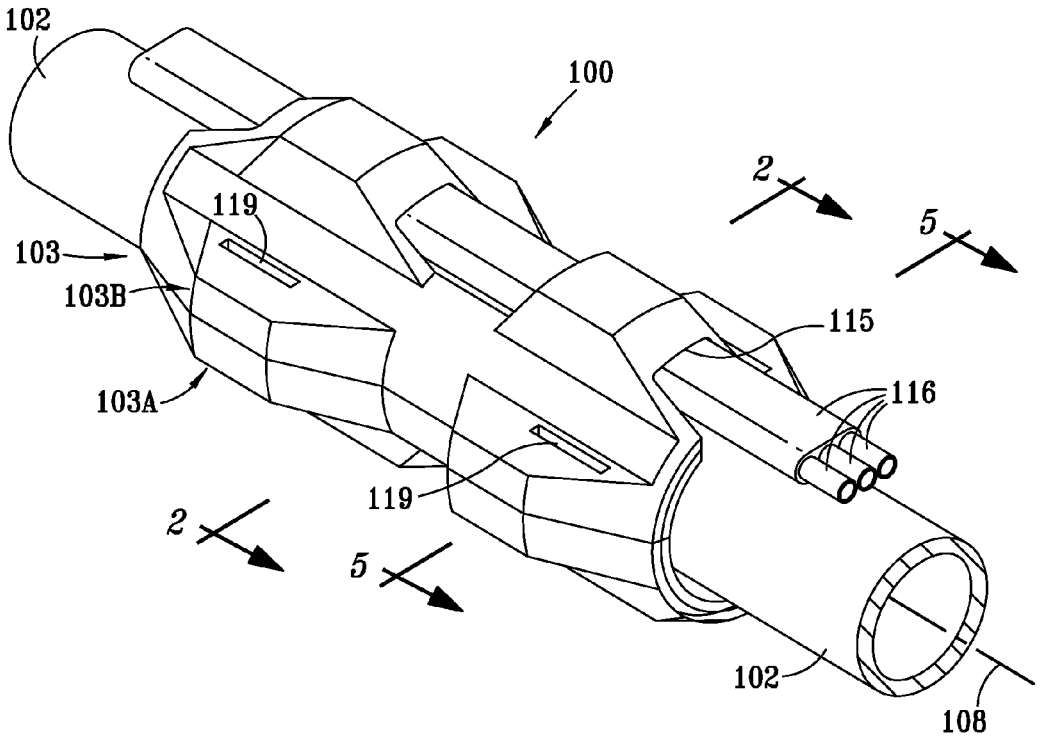
FIG. 1 is a perspective view exemplifying a centralizer embodying features of the present invention.

In the discussion of the FIGURES, the same reference numerals will be used throughout to refer to the same or similar components. In the interest of conciseness, various other components well known to the art, such as wellheads, drill pipe, drilling components, and the like necessary for the drilling and operation of the wells, have not been shown or discussed. Further, as used herein, the term "substantially" is to be construed as a term of approximation.

Referring to FIG. 1 of the drawings, the reference numeral 100 generally designates a system comprising two sections of drill pipe 102 joined together by a coupling (discussed in further detail below with respect to FIGS. 2-4) to which is mounted a centralizer 103 embodying features of the present invention. The centralizer 103 includes an annular body having having a substantially cylindrical bore extending longitudinally therethrough. The annular body is divided along a longitudinal axis 108 into at least a first, or lower (as viewed in FIG. 1), half section 103A and a second, or upper (as viewed in FIG. 1), half section 103B, the first and second sections being inter-connectable with each other, as discussed in further detail below with respect to FIGS. 2-10. The upper section 103B is depicted with a passageway 115 through which may be extended hydraulic or electrical conduits 116 or the like. The lower section 103A is depicted without a passageway 115, though it may optionally include same, or the upper section 103B may exclude the passageway 115, so that sections 103A and 103B would be identical, thereby simplifying inventory of parts. The centralizer 103 defines access slots 119 for use by a disassembly tool, discussed below with respect to FIGS. 11-14. The centralizer 103 is preferably fabricated from a relatively strong and durable electrically insulative material, such as nylon or the like, well know to those skilled in the art.

Figure 2:
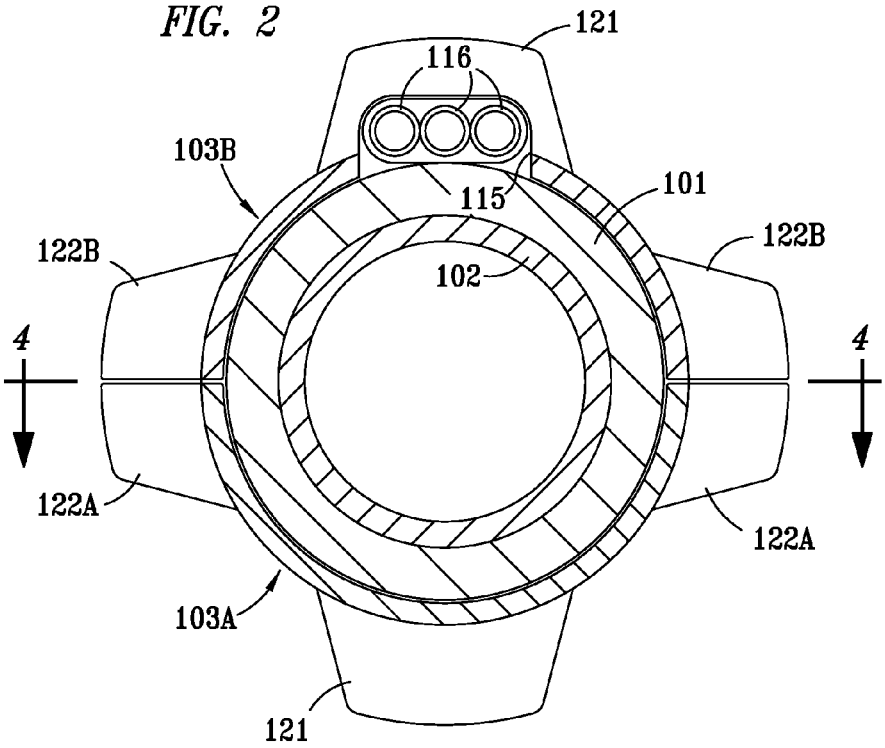
FIG. 2 is a cross-section of two mating parts of the centralizer of FIG. 1 taken along the line 2-2 of FIG. 1.

As shown most clearly in FIG. 2, lower section 103A of the centralizer 103 preferably includes a full fin (also referred to as a "blade") 121 and two half fins 122A. Similarly, the lower section 103B of the centralizer 103 preferably includes one full fin 121 and two half fins 122B. (It is understood that it is not required that the "half" fins 122A and 122B be literally half the size of a "full" fin.) The half fins 122A and 122B on the left side (as viewed in FIG. 2) of the centralizer form a full fin, and the half fins 122A and 122B on the right side (as viewed in FIG. 2) of the centralizer form a full fin. As shown at the cross-section of FIG. 2, then, the centralizer 103, preferably and effectively, includes four full fins. As may be appreciated from FIG. 1, there are two sets of four such fins, for a total of eight fins. Alternatively, there may be only one set of four fins, or there may be multiple sets of four fins. The fins are sized to abut the wall of a wellbore (not shown) and to keep the centralizer 103 centrally positioned within the wellbore, electrically insulated from the wellbore casing, while still allowing fluid to flow through the wellbore pass centralizer. Inasmuch as the centralizer 103 is preferably split longitudinally to be positioned about a drill pipe 102, it is preferable that the split occur at the fins, such as between the half fins 122A and 122B as shown in FIG. 2, rather than between full fins 121, to thereby enable the centralizer 103 to better withstand stresses that may be incurred while downhole. As also shown in FIG. 2, at the cross-section 2-2 of FIG. 1, the centralizer 103 preferably clamps about a coupling 101 that couples together two drill pipes 102, thereby maintaining the longitudinal position of the centralizer along the drill pipe 102.

Figure 3:
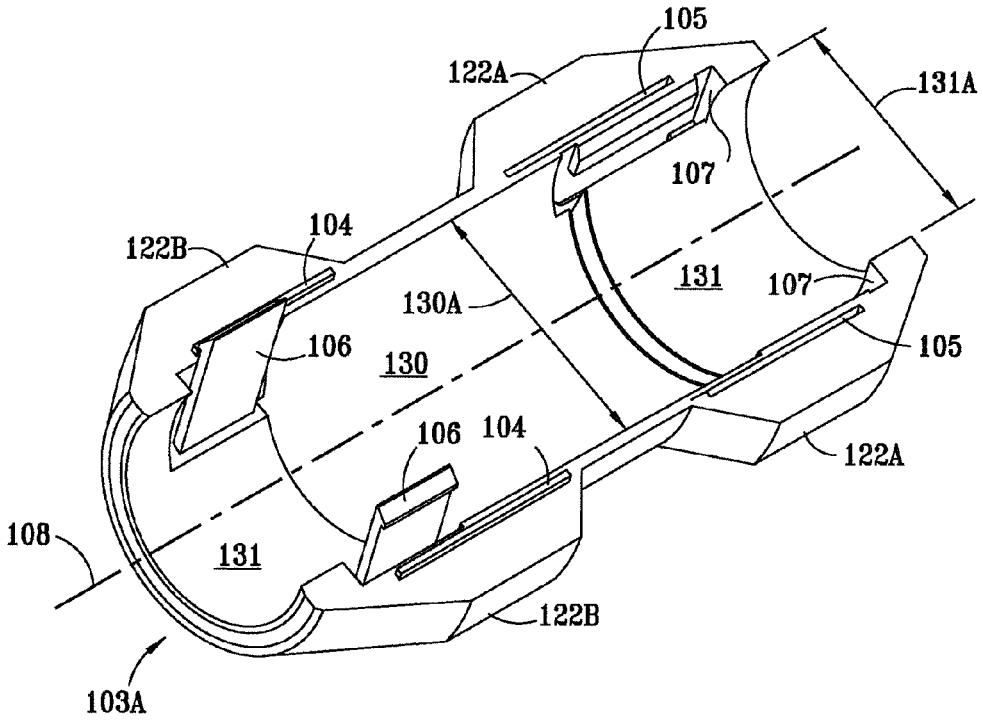
FIG. 3 depicts a perspective view of a lower section of the centralizer of FIG. 1.

FIG. 3 depicts a perspective view of the interior of the lower (as viewed in FIG. 3) section 103A of the centralizer 103. While the interior of the lower section 103A is exemplified, it is considered representative of the interior of the upper section 103B as well. The lower section 103A preferably defines a semi-cylindrically-shaped central portion 130 and two semi-cylindrically-shaped opposing end portions 131. The end portions preferably have a smaller inside diameter (ID) 131A than the ID 130A of center portion, as discussed in further detail below with respect to FIG. 4.

As shown in FIG. 3, the lower section 103A includes two cantilevered latches 106 and two latch cavities 107, which are configured for matingly engaging two corresponding latch cavities 107 and cantilevered latches 106, respectively, on upper section 103B, to thereby secure together the lower and upper sections 103A and 103B around a drill pipe 102. The interaction of the latches 106 with the latch cavities 107 is discussed in further detail below with respect to FIGS. 5-10.

The lower section 103A preferably also includes two guides 104 and two guide cavities 105, which are configured for matingly engaging two corresponding guide cavities 105 and guides 104, respectively, on upper section 103B, to thereby align and further secure together the lower and upper sections 103A and 103B around a drill pipe 102. It may be appreciated that the engagement of the guides 104 with the guide cavities 105 when the two sections 103A and 103B are joined together aids in preventing relative movement between the sections 103A and 103B in the radial or axial directions, thereby eliminating stress on the latches 106 that could result from side-loading as the drill pipe moves through a bend in a well bore or through a horizontal section of drill pipe or from drag from contact with the well bore. The interaction of the guides 104 with the guide cavities 105 is discussed in further detail below with respect to FIGS. 5-10.

Figure 4:
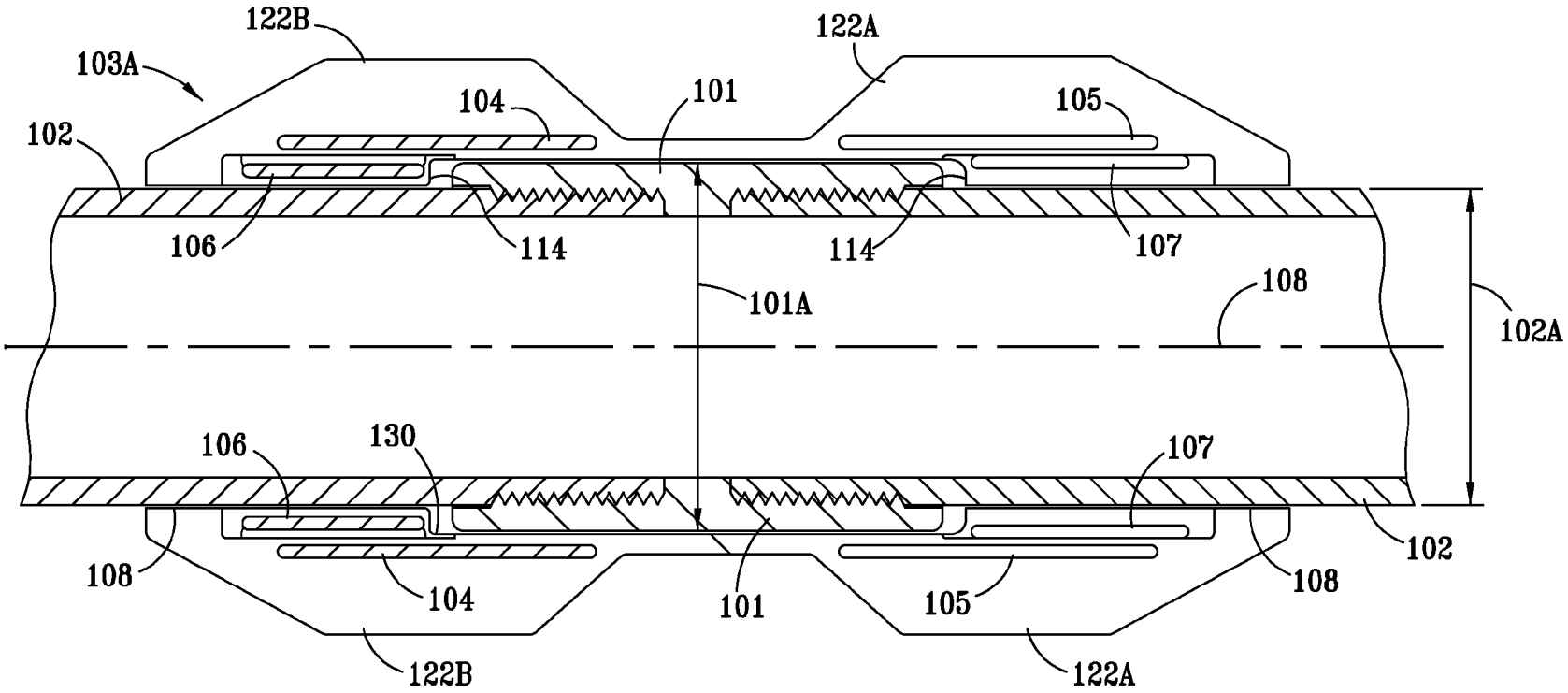
FIG. 4 depicts a cross-sectional view of the lower section of the centralizer of FIGS. 1 and 3 taken along the line 4-4 of FIG. 2.

FIG. 4 depicts a planar view of the lower section 103A of FIGS. 1 and 2, taken along the line 3-3 of FIG. 1. The ID 131A of the end portions 131 is suitably sized for clamping around the outside diameter (OD) 102A of the drill pipe 102. Similarly, the ID 130A of the central portion 130, greater than the ID 131A of the end portions 131, is suitably sized for clamping around a coupling 101 having an OD 101A, the coupling 101 being configured for joining together two sections of drill pipe 102.

A shoulder 114 is formed at each end of the center portion 130 where the center portion meets the end portions 131. The shoulders 114 are preferably sufficiently offset from the latches 106 to prevent loading of the latches 106. While the center portion 130 is sized for enveloping the coupling 101, the shoulders 114 may abut against either end of the coupling 101, to thereby restrain longitudinal movement of the centralizer 103 along the drill pipe 102, while allowing rotational movement of the centralizer about the drill pipe.

Figure 5:
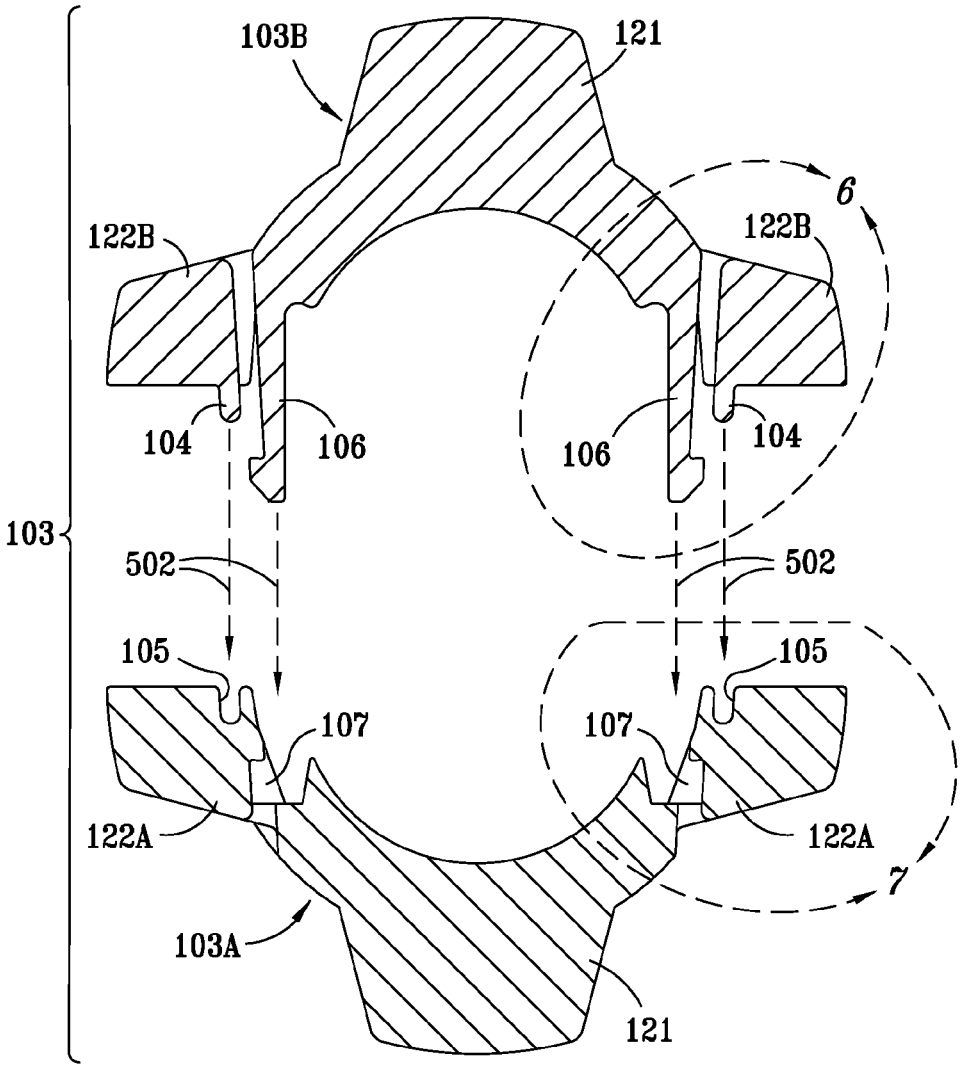
FIG. 5 exemplifies an exploded cross-sectional view of two mating sections of the centralizer of FIGS. 1 and 2 taken along the line 5-5 of FIG. 1.

FIG. 5 depicts a cross-sectional view of the centralizer 103 lower and upper sections 103A and 103B, respectively, taken along the line 5-5 of FIG. 1. Dashed lines 502 illustrate the path through which the latches 106 and guides 104 move toward corresponding latch cavities 107 and guide cavities 105, as the lower and upper sections 103A and 103B move toward engagement. Dashed lines 6 and 7 encircle latches, guides, latch cavities, and guide cavities which are discussed in greater detail below with respect to FIGS. 6 and 7.

Figure 6:
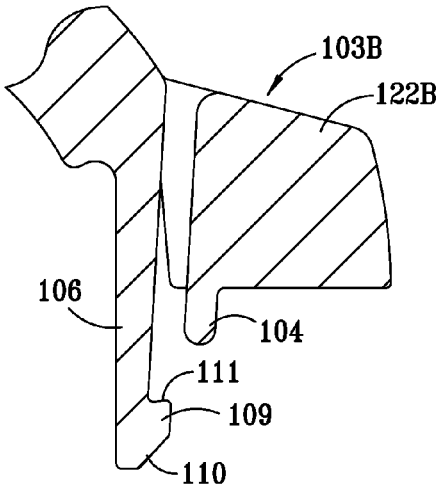
FIG. 6 is an enlarged view of the portion of FIG. 5 taken within the line 6 of FIG. 5.
Figure 7:
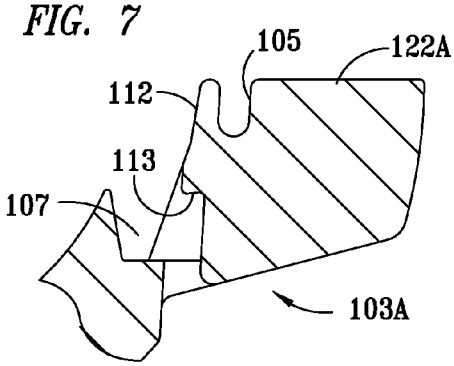
FIG. 7 is an enlarged view of the portion of FIG. 5 taken within the line 7 of FIG. 5.

FIG. 6 depicts details of the guide 104 and latch 106. As discussed above with respect to FIG. 3, the guide 104 is configured as a stub for matingly engaging the guide cavity 105 (FIG. 7). The latch 106 is configured as a cantilever beam having a tooth 109 formed on an end thereof, the tooth defining a beveled surface 110 and a tooth surface 111. As a cantilever beam, the latch 106 may deflect with the application of force on the beveled surface 110 thereof.

FIG. 7 depicts details of the guide cavity 105 and latch cavity 107. The guide cavity 105 is configured for matingly receiving and engaging the guide 104 (FIG. 6). The latch cavity 107 includes a wall surface 112 which generally follows an arc extending about the axis 108 (FIGS. 1, 3, 4) to a shoulder 113.

Figure 8:
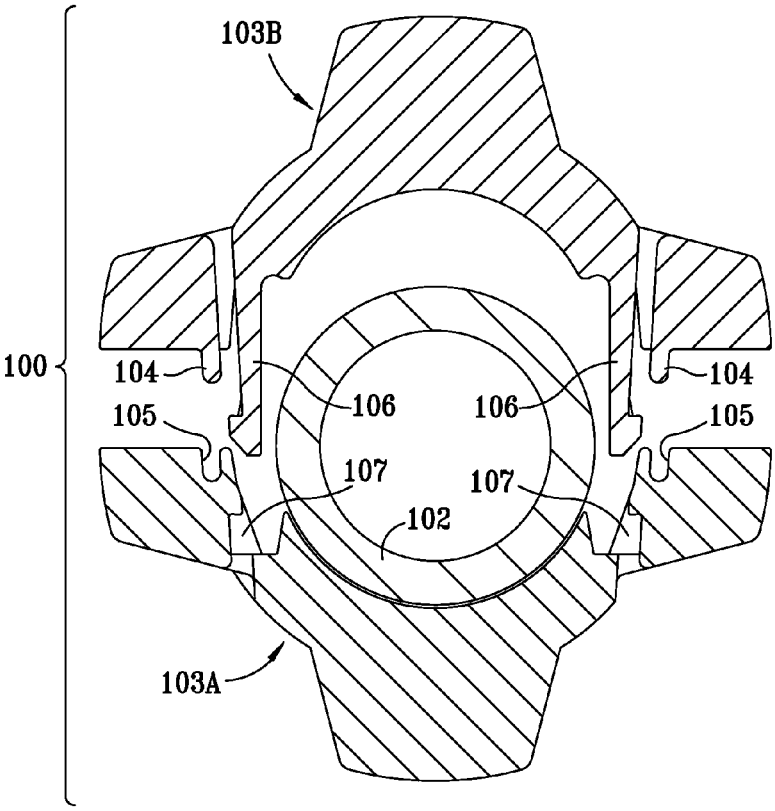
FIG. 8 depicts the two mating centralizer sections of FIG. 5 being positioned onto a drill pipe.
Figure 9:
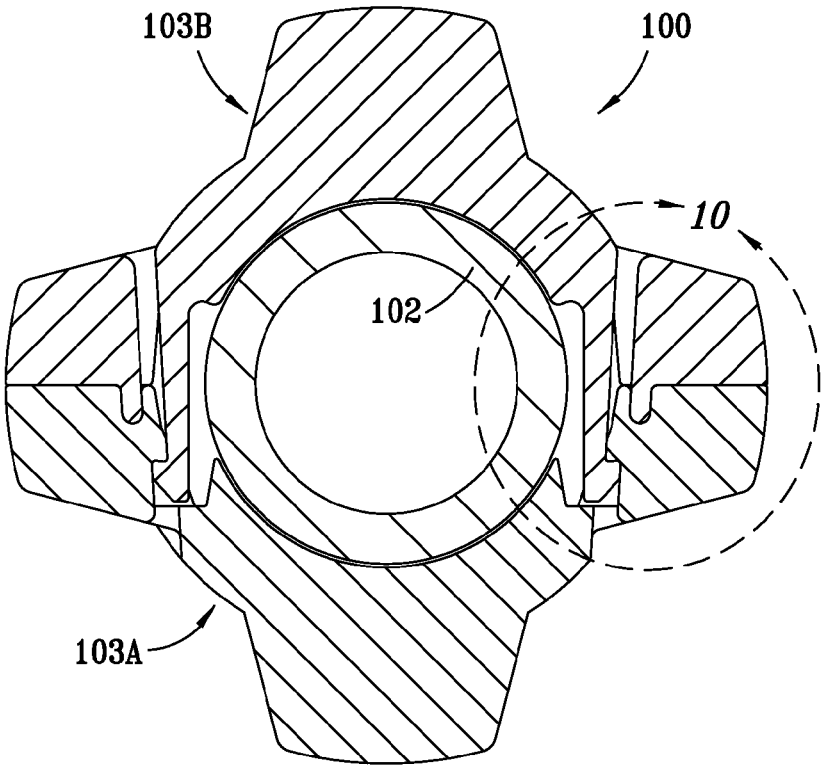
FIG. 9 depicts the two mating centralizer sections of FIG. 8 secured onto a drill pipe.
Figure 10:
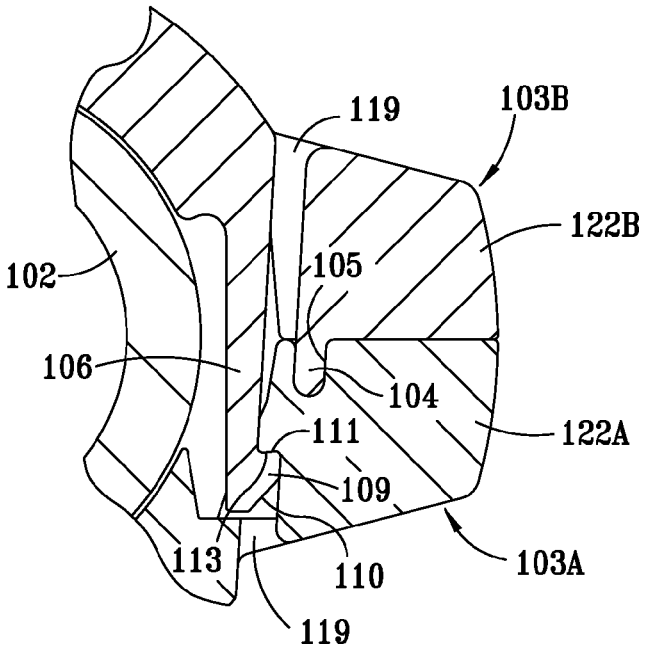
FIG. 10 is an enlarged view of the portion of FIG. 9 taken within the line 10 of FIG. 9.

FIGS. 8-10 depict operation of a preferred embodiment of the invention. As shown in FIG. 8, the two sections 103A and 103B of the centralizer 103 are positioned opposite each other with the drill pipe 102 interposed between the two sections. While not shown in FIG. 8, taken along the line 5-5 of FIG. 1, which does not show the coupling 101, the center portion 130 of the centralizer 103 is preferably positioned over the coupling 101 joining together two drill pipes 102. The two sections 103A and 103B are oriented in a complementary manner so that the latches 106 of each section are aligned with the respective latch cavities 107 of the other section. The two sections 103A and 103B are then pressed together causing the beveled surface 110 to be urged against the latch cavity wall surface 112, thereby deflecting the latch 106 until the tooth 109 passes the shoulder 113, at which time the latch snaps back to an undeflected state and the tooth surface 111 seats on the shoulder 113, thereby fully engaging the latches 106 with respective latch cavities 107 and interlocking the two sections 103A and 103B, and reducing tension on the latch 106 which could cause it to deflect and disengage from the latch cavity 107.

Further, as the two sections 103A and 103B are pressed together, the guides 104 matingly engage respective guide cavities 105 to align and further secure together the lower and upper sections 103A and 103B around a drill pipe 102, aiding in reducing relative movement between the sections 103A and 103B in the radial or axial directions, thereby reducing stress on the latches 106 that could result from side-loading as the drill pipe moves through a bend in a well bore or through a horizontal section of drill pipe or from drag from contact with the well bore. Upon engagement of the latches 106 with the latch cavities 107, and the engagement of the guides 104 with the guide cavities 105, the two sections 103A and 103B become interlocked and secured about the drill pipe 102, as shown in FIG. 9. FIG. 10 depicts a detail portion of FIG. 9 taken within the dashed line 10 of FIG. 9.

Figure 11:
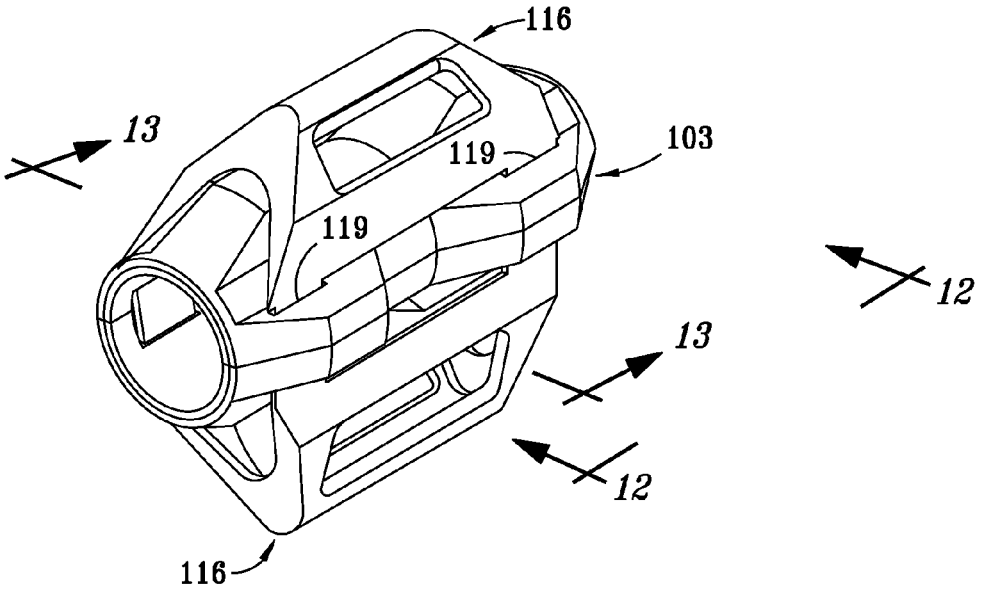
FIG. 11 is a perspective view exemplifying the centralizer of FIG. 1 with a disassembly tool attached thereto for separating the two sections of the centralizer in accordance with principles of the present invention.
Figure 12:
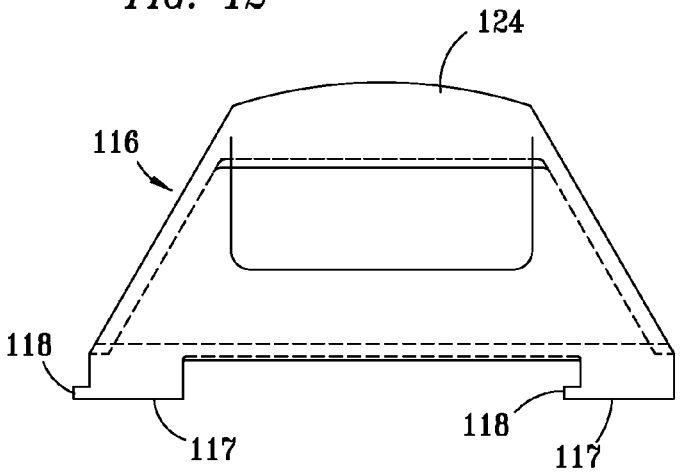
FIG. 12 is an elevation view of one disassembly tool of FIG. 11.
Figure 13:
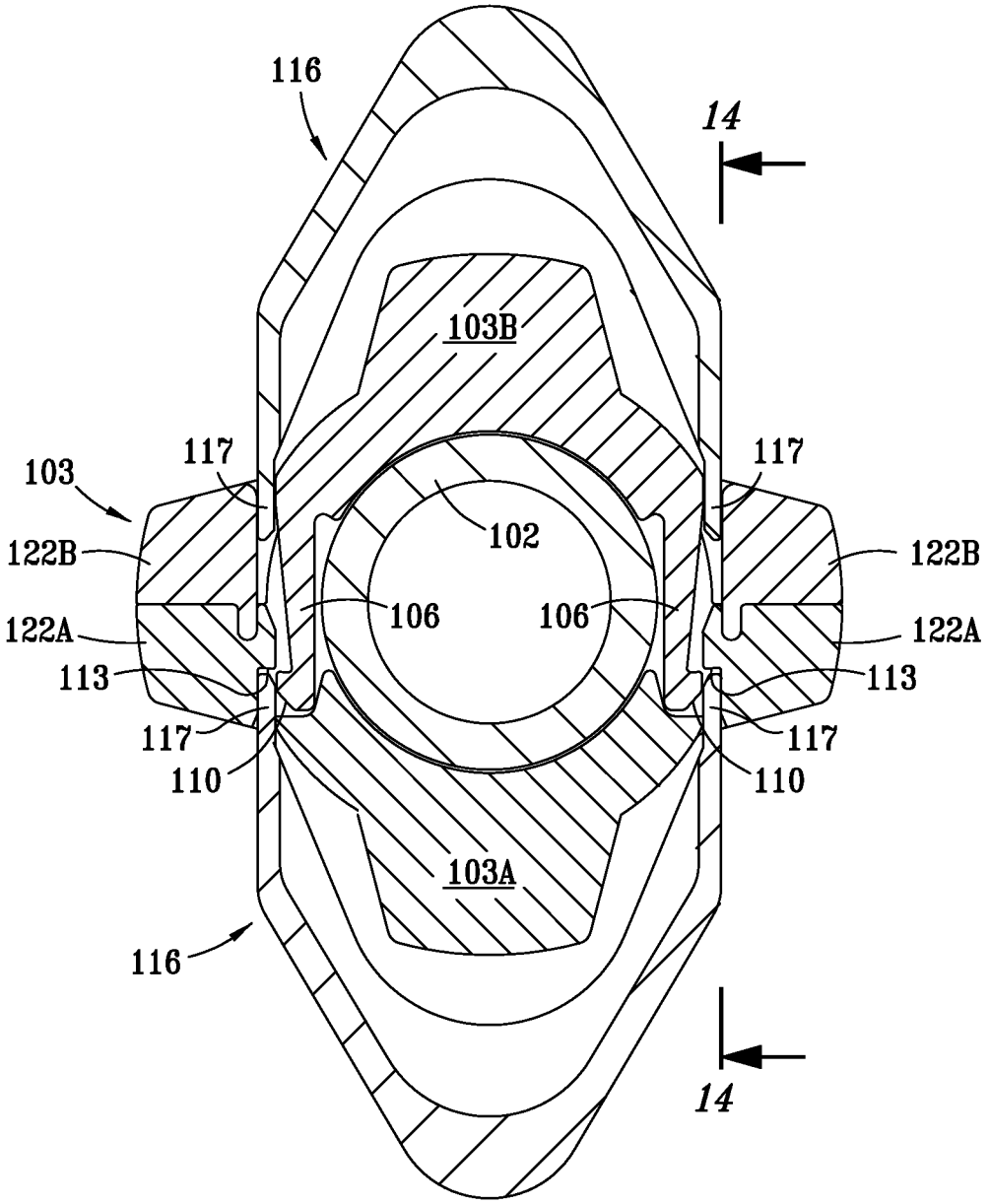
FIG. 13 is a cross-sectional view of the centralizer and tool of FIG. 11 taken along the line 13-13 of FIG. 11.

FIG. 11 depicts the centralizer 103 with a disassembly tool 116 mounted thereto for separating the lower and upper sections 103A and 103B of the centralizer 103. FIG. 12 is a side view of the tool showing two tabs 117, each tab including a hook 118 extending from the tab. The tool 116 preferably includes a handle 124 and two tabs 117 and hooks 118 on each side of the tool, for a total of four tabs and hooks on each tool 116. The tabs 117 are configured for sliding into the access slots 119 (FIGS. 1 and 11). The slots 119 are defined proximate to a respective latch 106 or latch cavity 107. One tool 116 is preferably used on each section 103A and 103B of the centralizer 103, i.e., two tools, are preferably used to separate the two sections of the centralizer. With reference to FIG. 13, when the tabs 117 are entered into the access slots 119, they may abut the base of a latch 106 (upper section 103B in FIG. 13), or they may abut the beveled surface 110 of a latch 106 (lower tool section 103A in FIG. 13). Insofar as the tabs 117 abut the beveled surface 110, the latches 106 will deflect away from the respective shoulder surfaces 113, thereby disengaging the two latches 106 from their respective latch cavities 107, allowing the two sections 103A and 103B to be pulled apart from each other and from the coupling 101 and drill pipe 102, as discussed below with respect to FIG. 14.

Figure 14:
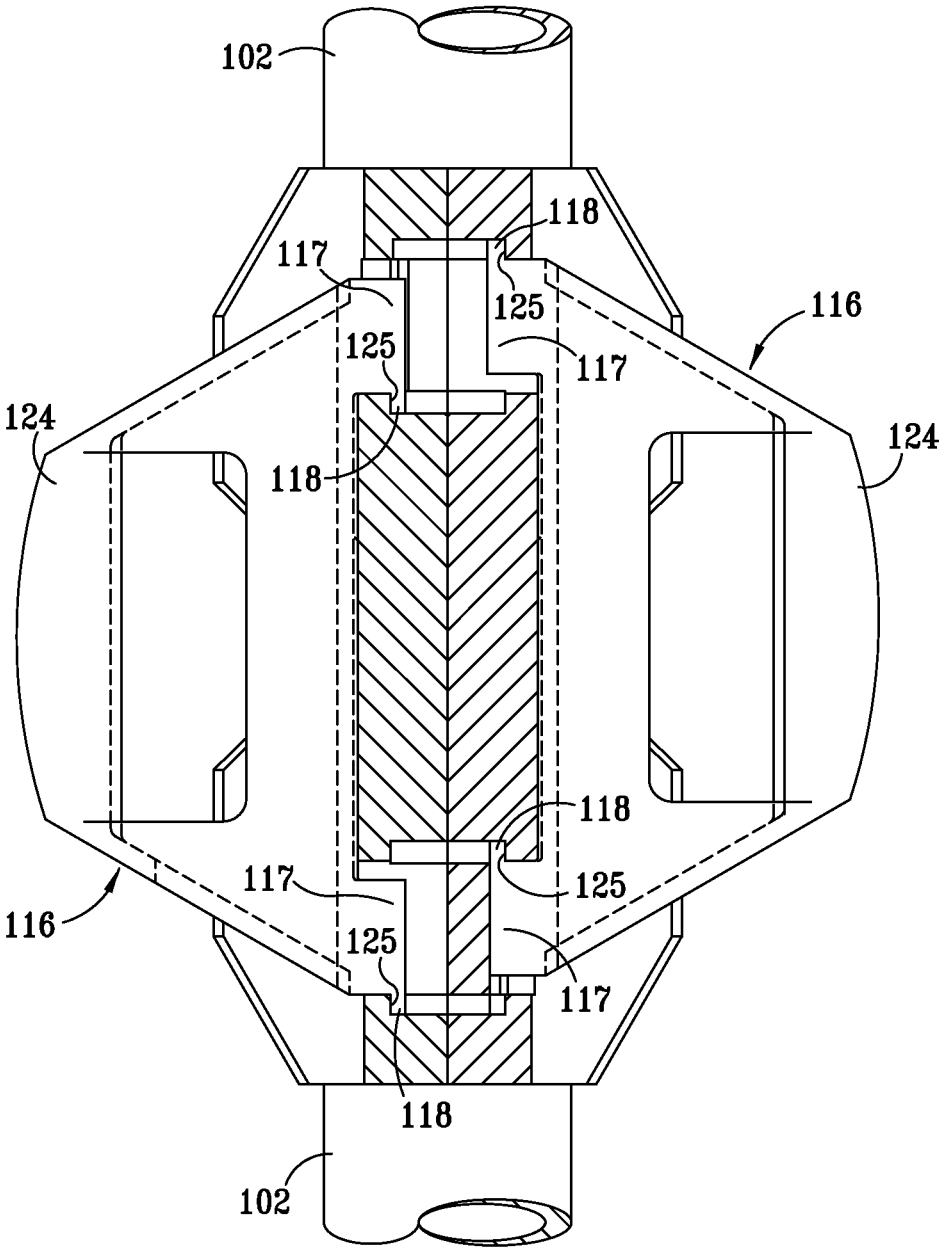
FIG. 14 is a cross-sectional view of the centralizer and tool of FIGS. 11 and 12 taken along the line 14-14 of FIG. 13.

As shown in FIG. 14, the two disassembly tools 116 are preferably oriented so that the hooks 118 of the two tools are pointing in opposing directions. Then, when the tabs 117 are entered into the access slots 119, deflecting and disengaging the latches 106 from the latch cavities 107 as discussed supra, one tool 116 (right tool in FIG. 14) is slid up and the other tool (left tool in FIG. 14) is slid down, consistent with the direction of their respective hooks 118, until the hooks 118 are seated on hook shoulders 125, thereby locking the tools to the respective sections of the centralizer 103. When the tools 116 are slid up or down, the centralizer 103 is preferably restrained from sliding up or down by the shoulders 114 which abut the coupling 101. Once the tools 116 are secured to the centralizer 103, radial force, directed away from the drill pipe 102, may then be applied (e.g., by one or two persons, not shown) to the handles 124 of the tools 116 to pull the centralizer sections 103A and 103B apart from each other and away from the drill pipe 102.

It can be appreciated that, as described above with respect to one preferred embodiment of the invention, the centralizer 103 is positioned across the tubular coupling 101 since this is a natural point of contact that would occur in the wellbore. In most vertical wells or wells with gentle deviations the use of one centralizer 103 per joint of pipe 102 at the coupling 101 is sufficient to ensure that the strings of drill pipe 102 do not contact the wall of the wellbore (not shown). However, in severely doglegged wellbores or where extreme amounts of helical buckling are anticipated, it may be required to run centralizers at mid joint locations. In such cases a tubing stop collar may be positioned on drill pipe 102 as desired to positioned centralizers mid joint along a pipe. A stop collar that presents a cylindrical upset of dimensions similar to the tubular coupling 101, including the feature of flat end faces, will allow the placement of the centralizer 103 anywhere along a drill pipe in the same manner as discussed above with respect to a tubular coupling 101.

The present invention provides a number of advantages over the prior art. For example, because the half sections of the centralizer 103 are not configured as matched sets and do not need to be snapped together for storage, the centralizer can be stored in halves nested together, thereby simplifying inventory, requiring less space, and requiring less fabrication molds. In a further example, if one half becomes damaged, only that piece need be discarded, rather than both half sections of a whole centralizer. The low latch profile makes it possible for the centralizer to be used where annular clearance is limited compared to hinge and bolt designs as used in the prior art. For centralizers fabricated from a plastic, a simple two piece mold may be used to make the part, and because the latch position remains the same for drill pipe or tubing having a particular outside diameter (OD), the mold can be easily modified for combinations of tubing OD and wellbore casing inside diameter (ID).

It is understood that the present invention may take many forms and embodiments. Accordingly, several variations may be made in the foregoing without departing from the spirit or the scope of the invention. For example, the guide 104, guide cavity 105, latch 106, and latch cavity 107 could be re-arranged to each be respectively on the same side of the centralizer or cattycorner from each other. Two additional hooks 118 may be extended from the tabs 117 in the opposite direction as shown in FIG. 12, for a total of four hooks in FIG. 12, so that a user may move the disassemble tool 116 up or down to interlock the tool to the centralizer 103.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A casing centralizer comprising an annular body having a substantially cylindrical bore extending longitudinally therethrough, wherein said annular body is divided along its axis into at least a first section and a second section;

said first section further comprising:

one or more first fins extending radially from said first section; and one or more latches, wherein at least one of said one or more latches is formed in at least one of said one or more first fins; and said second section further comprising:

one or more second fins extending radially from said second section; and one or more latch cavities configured for matingly receiving and interconnecting with said one or more latches, wherein at least one of said one or more latch cavities is formed in at least one of said one or more second fins.

2. The centralizer of claim 1, wherein said one or more latches are one or more first latches, said one or more latch cavities are one or more second latch cavities, said first section further comprises one or more first latch cavities, and said second section further comprises one or more second latches configured for matingly engaging and interconnecting with said one or more first latch cavities.

3. The centralizer of claim 1, wherein:

said substantially cylindrical bore of said annular body includes an end portion at each end of said substantially cylindrical bore and a central portion interposed between said end portions; and each of said end portions are defined by a first inside diameter (ID) sized for circumscribing an outside diameter (OD) of a drill pipe, and said central portion is defined by a second ID sized for circumscribing an OD of a coupling joining two sections of drill pipe.

4. The centralizer of claim 1, wherein:

said substantially cylindrical bore of said annular body includes an end portion at each end of said substantially cylindrical bore and a central portion interposed between said end portions; and each of said end portions are defined by a first inside diameter (ID) sized for circumscribing an outside diameter (OD) of a drill pipe, and said central portion is defined by a second ID sized for circumscribing an OD of a stop collar mounted on a drill pipe.

5. The centralizer of claim 1, wherein:

said one or more latches are one or more first latches, said one or more latch cavities are one or more second latch cavities, said first section further comprises one or more first latch cavities, and said second section further comprises one or more second latches configured for matingly engaging and interconnecting with said one or more first latch cavities;

said first section of said annular body defines a first end and a second end, said first end being longitudinally opposed to said second end;

said one or more first latches are formed on said first end of said first section of said annular body;

said one or more first latch cavities are formed on said second end of said first section of said annular body;

said second section of said annular body defines a first end and a second end, said first end being longitudinally opposed to said second end;

said one or more second latches are formed on said second end of said second section of said annular body; and said one or more second latch cavities are formed on said first end of said second section of said annular body.

6. The centralizer of claim 1, wherein:

said first section of said annular body further comprises one or more alignment guides; and said second section of said annular body further comprises one or more alignment guide cavities configured for matingly receiving with said one or more alignment guides.

7. The centralizer of claim 1, wherein:

said first section of said annular body further comprises:

one or more first alignment guides; and one or more first alignment guide cavities; and said second section of said annular body further comprises:

one or more second alignment guides configured for matingly engaging with said one or more first alignment guide cavities; and one or more second alignment guide cavities configured for matingly receiving with said one or more first alignment guides.

8. The centralizer of claim 1, wherein:

said first section of said annular body defines a first end and a second end, said first end being longitudinally opposed to said second end, said first section further comprising:

one or more first alignment guides formed on said first end of said first section; and one or more first alignment guide cavities formed on said second end of said first section; and said second section of said annular body defines a first end and a second end, said first end being longitudinally opposed to said second end, said second section further comprising:

one or more second alignment guide cavities formed on the first end of said second section configured for matingly engaging with said one or more first alignment guides; and one or more second alignment guides formed on the second end of said second section configured for matingly engaging with said one or more first alignment guide cavities.

9. The centralizer of claim 1, wherein said at least one first fin defines a passageway sized for the passage therethrough of at least one of a hydraulic conduit and a electrical conduit.

10. The centralizer of claim 1, wherein said centralizer is fabricated from a substantially electrically insulative material.

11. The centralizer of claim 1, wherein said at least one latch defines a beveled end and said centralizer further comprises a disassembler tool, said disassembler tool including:

at least one tab for inserting in said at least one latch cavity between said beveled end of at least one of said one or more latches and a wall of at least one of said one or more latch cavities to deflect said latch; and at least one hook extending from said at least one tab configured for seating against a shoulder of at least one of said one or more latch cavities.

12. A method for centrally positioning drill pipe in a borehole casing via a casing centralizer comprising an annular body having a substantially cylindrical bore extending longitudinally therethrough, wherein said annular body is divided along its axis into at least a first section and a second section, the method comprising steps of:

positioning opposite each other over a drill pipe said first section and said second section of said annular body, wherein:

said first section further comprises:

one or more first fins extending radially from said first section; and one or more latches, each of said one or more latches including a tooth having a tooth surface and beveled surface; and said second section further comprises:

one or more second fins extending radially from said second section; and one or more latch cavities configured for matingly receiving and interconnecting with said one or more latches, each of said one or more latch cavities having a wall and a shoulder;

applying force to move said first section and said second section toward each other together until said beveled end of each of said one or more latches is urged against said wall of a respective each of said one or more latch cavities thereby deflecting each of said one or more latches until said tooth extends pass said shoulder and said tooth surface of each of said one or more latches seats against a respective wall of said one or more latch cavities.

13. The method of claim 12, wherein said one or more latches are one or more first latches, said one or more latch cavities are one or more second latch cavities, said first section further comprises one or more first latch cavities, said second section further comprises one or more second latches configured for matingly engaging and interconnecting with said one or more first latch cavities, and said step of applying force further comprises:

applying force to move said first section and said second section together until said beveled end of each of said one or more second latches is urged against said wall of a respective each of said one or more first latch cavities thereby deflecting each of said one or more second latches until said tooth of said respective one or more second latches extends pass said shoulder of said respective one or more first latch cavities and said tooth surface of each of said one or more second latches abuts against a respective wall of said one or more first latch cavities.

14. The method of claim 12, wherein:

said substantially cylindrical bore of said annular body includes an end portion at each end of said substantially cylindrical bore and a central portion interposed between said end portions;

each of said end portions are defined by a first inside diameter (ID) sized for circumscribing an outside diameter (OD) of a drill pipe, and said central portion is defined by a second ID sized for circumscribing an OD of a coupling joining two sections of drill pipe; and said step of positioning further comprises positioning said central portion of said first section and said second section over a coupling of said drill pipe.

15. The method of claim 12, wherein:

said substantially cylindrical bore of said annular body includes an end portion at each end of said substantially cylindrical bore and a central portion interposed between said end portions;

each of said end portions are defined by a first inside diameter (ID) sized for circumscribing an outside diameter (OD) of a drill pipe, and said central portion is defined by a second ID sized for circumscribing an OD of a stop collar mounted on drill pipe; and said step of positioning further comprises positioning said central portion of said first section and said second section over a stop collar mounted on said drill pipe.

16. The method of claim 12, wherein:

said first section of said annular body further includes one or more alignment guides;

said second section of said annular body further includes one or more alignment guide cavities configured for matingly receiving with said one or more alignment guides; and said step of positioning further comprises positioning said central portion of said first section and said second section to engage said one or more alignment guides with respective said one or more alignment guide cavities.

17. The method of claim 12, wherein said at least one first fin defines a passageway, and said method further comprises extending at least one of a hydraulic conduit and a electrical conduit through said passageway.

18. The method of claim 12, wherein:

at least one of said one or more latches is formed in said at least one of said one or more first fins;

at least one of said one or more latch cavities is formed in said at least one of said one or more second fins; and said step of positioning further comprises positioning said first section and said second section so that said at least one of said one or more first fins are aligned with and abut said at least one of said one or more second fins.

19. The method of claim 12, wherein said at least one latch defines a beveled end and said centralizer further comprises two disassembler tools, each of said disassembler tools having one or more tabs, each of said tabs having at least one hook, said method further comprising:

inserting at least one tab of each of said disassembler tools through a respective one of one or more access slots of said centralizer proximate to a respective one of said one or more latches or proximate to a respective one of said one or more latch cavities between said beveled end of each of said one or more latches and a wall of respective said one or more latch cavities thereby deflecting said one or more latches until said tooth surface of each of said one or more latches is unseated from said shoulder of each of respective said one or more latch cavities;

seating said one or more hooks against a respective hook shoulder of said centralizer by moving said tools longitudinally to interlock said tools to said respective first section and said second section of said centralizer; and applying radial force to each tool in opposing directions to separate said first section from said second section of said centralizer and thereby remove said centralizer from said drill pipe.

* * * * *